US009226639B1

(12) United States Patent
Sheu

(10) Patent No.: US 9,226,639 B1
(45) Date of Patent: Jan. 5, 2016

(54) FLAT MOP TOOL

(71) Applicant: Miin-Shiou Sheu, Changhua County (TW)

(72) Inventor: Miin-Shiou Sheu, Changhua County (TW)

( * ) Notice: Subject to any disclaimer, the term of this patent is extended or adjusted under 35 U.S.C. 154(b) by 0 days.

(21) Appl. No.: 14/722,301

(22) Filed: May 27, 2015

(51) Int. Cl.

| | |
|---|---|
| ***A47L 13/16*** | (2006.01) |
| ***A47L 13/256*** | (2006.01) |
| ***A47L 13/258*** | (2006.01) |
| ***A47L 13/44*** | (2006.01) |

(52) U.S. Cl.
CPC ..... *A47L 13/256* (2013.01); *A47L 13/16* (2013.01); *A47L 13/258* (2013.01); *A47L 13/44* (2013.01)

(58) Field of Classification Search
CPC ..... A47L 13/16; A47L 13/256; A47L 13/258; A47L 13/44
See application file for complete search history.

(56) References Cited

U.S. PATENT DOCUMENTS

| | | | | |
|---|---|---|---|---|
| 1,998,634 | A * | 4/1935 | Oberti | A47L 13/44 15/121 |
| 3,099,855 | A * | 8/1963 | Nash | A47L 13/29 15/231 |
| 6,058,552 | A * | 5/2000 | Hanan | A47L 13/256 15/228 |
| 7,290,305 | B1 * | 11/2007 | Auchmoody | A47L 13/256 15/228 |
| 2002/0138934 | A1 * | 10/2002 | Petner | A47L 13/44 15/229.6 |

* cited by examiner

*Primary Examiner* — Randall Chin
(74) *Attorney, Agent, or Firm* — Jackson IPG PLLC; Demian K. Jackson

(57) ABSTRACT

A flat mop tool is provided. When it is moved forward and applied with a force, first connecting members are pushed forward to slant upward and a second board portion is in contact with the ground tightly; meanwhile, the front upper ends of the first connecting members lift a first board portion upward to be away from the ground through third connecting members. The dust on the ground is pushed forward to be underneath the first board portion to collect dust forward. When it moved rearward and applied with a force, the first connecting members are pushed rearward to slant upward and the first board portion is pushed downward to get contact with the ground to collect and attract the dust; meanwhile, the second board portion is lifted upward and the dust is pushed rearward to be underneath the second board portion to collect dust rearward.

16 Claims, 7 Drawing Sheets

FLAT MOP TOOL

BACKGROUND OF THE INVENTION

1. Field of the Invention

The present invention relates to a flat mop tool, and more particularly to a flat mop tool which can be moved frontward and rearward for dusting.

2. Description of the Prior Art

As shown in FIG. 1, a conventional flat mop tool 200 comprises a bottom board 210, a raised axle 220, and a mop pole 230.

The raised axle 220 is disposed above the bottom board 210. The mop pole 230 is pivotally connected with the raised axle 220. A dusting paper 300 is provided and disposed underneath the bottom board 210.

When flat mop tool 200 is used for dusting, the user holds the mop pole 230 to move forward and rearward. Because the dusting paper 300 is attached to the lower surface of the bottom board 210, the dust will be accumulated at the front side or the rear side of the bottom board 210. For the accumulated dust attracted to the dusting paper 300 by means of static, the bottom board 210 is first lifted forward through the mop pole 230 and then moved rearward, alternatively, the bottom board 210 is first lifted rearward and then moved frontward for the accumulated dust to be underneath the dusting paper 300, such that the dust can be attracted to the dusting paper 300. The operation is troublesome in use. Accordingly, the inventor of the present invention has devoted himself based on his many years of practical experiences to solve these problems.

SUMMARY OF THE INVENTION

The present invention is to provide a flat mop tool. The flat mop tool comprises a base, two first connecting members, a mop pole, two second connecting members, two third connecting members, and a board. The base has two side portions, a flat portion, and two raised portions. The two side portions extend downward from two ends of the flat portion, respectively. A central portion of the flat portion is formed with an opening. The two raised portions are located at two ends of the opening, respectively. The axial direction of each raised portion is parallel to the radial direction of the flat portion. Each raised portion is formed with a first pivot hole at a central portion thereof. Each side portion is formed with a second pivot hole at a central portion thereof. Each first connecting member has a plate body, a front upper connecting hole, a rear upper connecting hole, a middle upper connecting hole, and a middle lower connecting hole. The front upper connecting hole and the rear upper connecting hole are formed at a front upper end and a rear upper end of the plate body, respectively. The middle upper connecting hole is formed at a middle upper portion of the plate body and located between the front upper connecting hole and the rear upper connecting hole. The middle lower connecting hole is formed at a middle lower end of the plate body and corresponds to the middle upper connecting hole. The two first connecting members are spaced and located in the opening. The middle upper connecting hole of each first connecting member is pivotally connected with the first pivot hole of a corresponding one of the two raised portions. The mop pole passes through the opening and is located between the two first connecting members. Two ends of a bottom end of the mop pole are pivotally connected with the middle lower connecting holes of the two first connecting members. The two second connecting members are located in the opening and beside the two first connecting members. An upper end of each second connecting member is pivotally connected with the rear upper connecting hole of a corresponding one of the two first connecting members. The two third connecting members are located in the opening and beside the two first connecting members. An upper end of each third connecting member is pivotally connected with the front upper connecting hole of a corresponding one of the two first connecting members. The board is located underneath the flat portion of the base and between the two side portions. Two ends of the board are pivotally connected with the second pivot holes of the two side portions, respectively. The board has a first board portion and a second board portion. An obtuse angle is defined between an upper surface of the first board portion and an upper surface of the second board portion. The first board portion is provided with two first pivot seats corresponding in position to the two third connecting members. The second board portion is provided with two second pivot seats corresponding in position to the two second connecting members. A lower end of each third connecting member is pivotally connected with a corresponding one of the two first pivot seats. A lower end of each second connecting member is pivotally connected with a corresponding one of the two second pivot seats.

Preferably, the two first connecting members each have a reverse triangular shape.

Preferably, the flat mop tool further comprises four pads or four wheels disposed at two sides of lower ends of the two side portions.

Preferably, two ends of the upper surface of the first board portion and the upper surface of the second board portion are formed with retaining portions, respectively.

Preferably, a dusting paper or a dusting cloth is provided to wrap a lower surface of the board. One side of the dusting paper or the dusting cloth is bent upward to be retained by the retaining portions of the first board portion, and the other side of the dusting paper or the dusting cloth is bent upward to be retained by the retaining portions of the second board portion.

Preferably, a dusting pad is disposed under the board.

Accordingly, when the user holds the mop pole to move forward and apply a force (namely, toward the direction of the first board portion) by using the pads and the wheels, the first connecting members will be pushed forward to slant upward. The rear upper ends (namely, the position of the rear upper connecting holes) of the first connecting members push the second board portion downward through the second connecting members, such that a portion of the dusting paper (or the dusting cloth) or the dusting pad, at the lower surface of the second board portion, is in contact with the ground tightly; meanwhile, the front upper ends (namely, the position of the front upper connecting holes) of the first connecting members lift the first board portion upward to be away from the ground through the third connecting members. Thus, the dust or objects on the ground are pushed forward to be underneath the first board portion (or underneath the dusting paper or the dusting cloth or the dusting pad at the lower surface of the first board portion) to collect dust forward.

When the user holds the mop pole to move rearward and apply a force (namely, toward the direction of the second board portion) by using the pads and the wheels, the first connecting members will be pushed rearward to slant upward. The front upper ends (namely, the position of the front upper connecting holes) of the first connecting members push the first board portion downward to get contact with the ground through the third connecting members, such that a portion of the dusting paper (or the dusting cloth) or the dusting pad, at the lower surface of the first board portion, is in contact with the ground tightly to collect and attract the dust or the objects therebetween; meanwhile, the rear upper ends (namely, the position of the rear upper connecting holes) of the first connecting members lift the second board portion upward through the second connecting members. Thus, the portion of the dusting paper (or the dusting cloth) or the dusting pad, at the lower surface of the second board portion, is away from the ground, and the dust or objects on the ground are pushed rearward to be underneath the second board portion (or underneath the dusting paper or the dusting cloth or the dusting pad at the lower surface of the second board portion) to collect dust rearward. That is, the user can apply a force frontward to collect the front dust and to dust the rear dust and apply a force rearward to collect the rear dust and to dust the front dust. Thus, the present invention can be moved frontward and rearward for dusting.

DETAILED DESCRIPTION OF THE PREFERRED EMBODIMENTS

Figure 1:
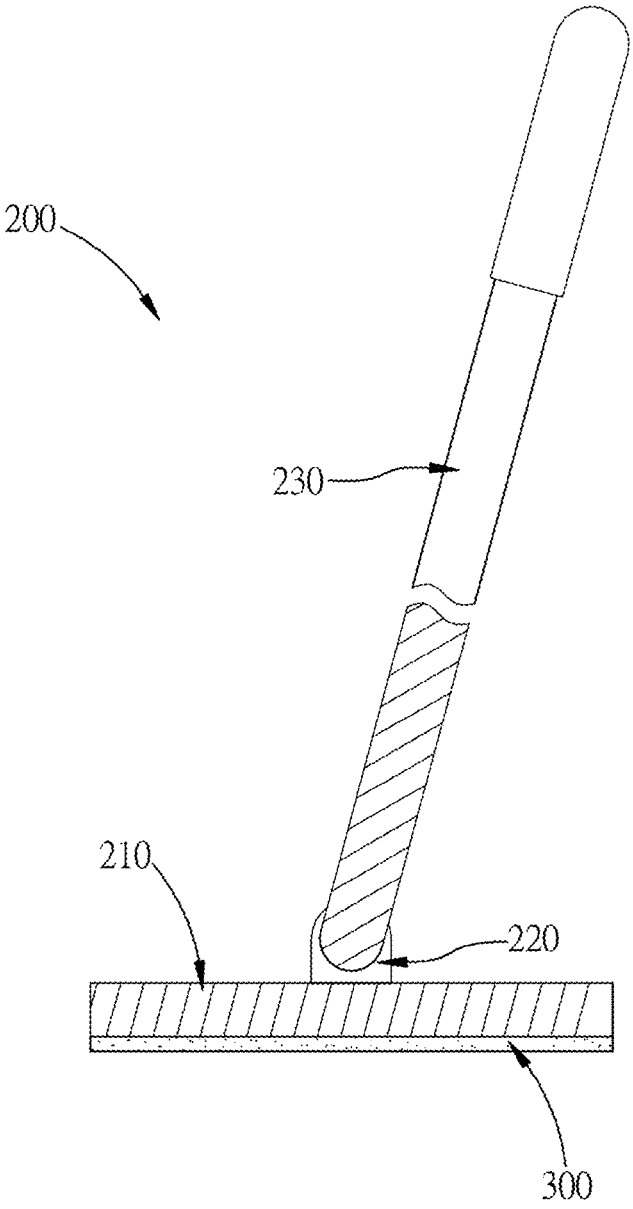
FIG.1 PRIOR ART
FIG. 1 is a schematic view of a conventional flat mop tool.
Figure 2:
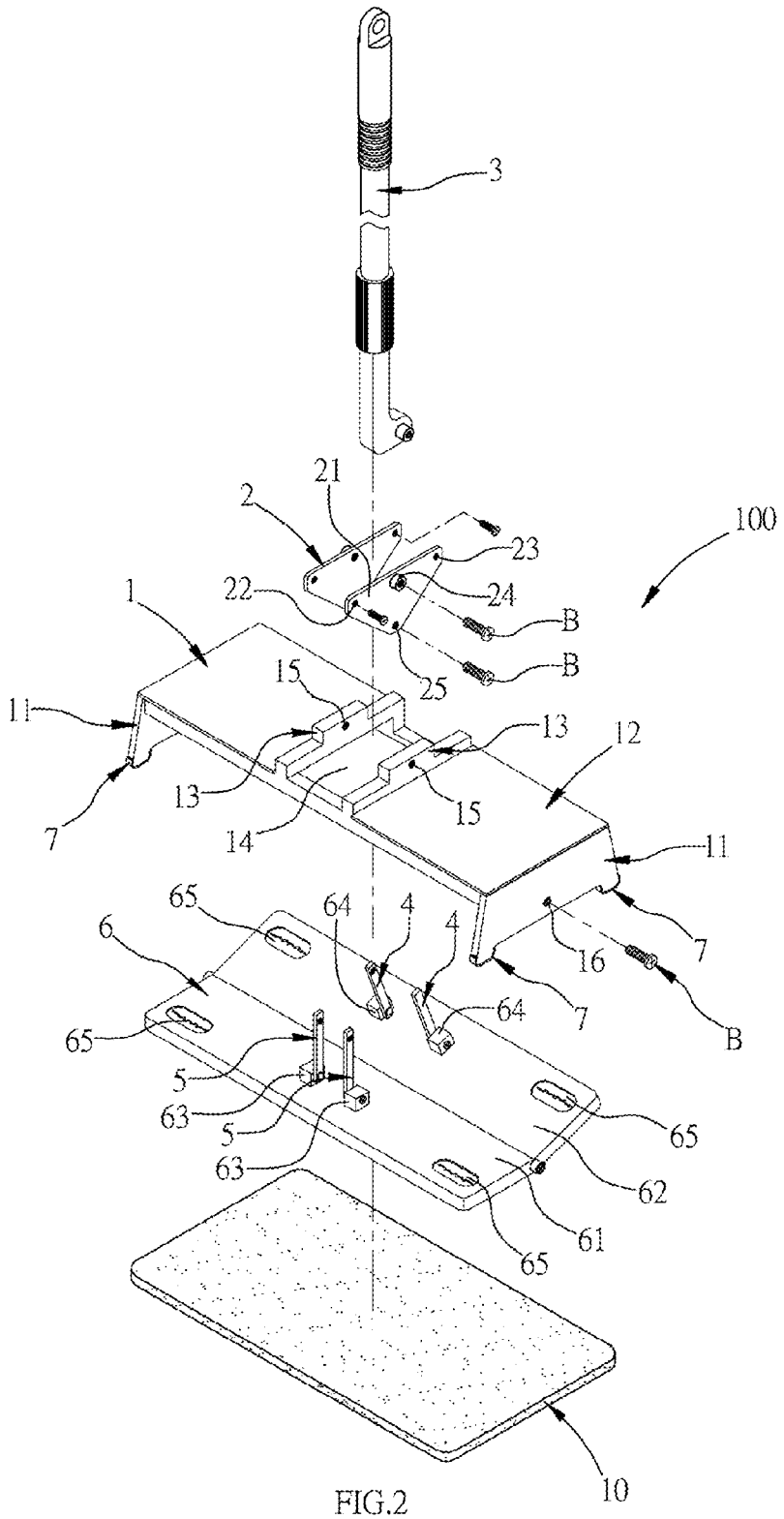
FIG. 2 is an exploded view according to a preferred embodiment of the present invention.
Figure 3:
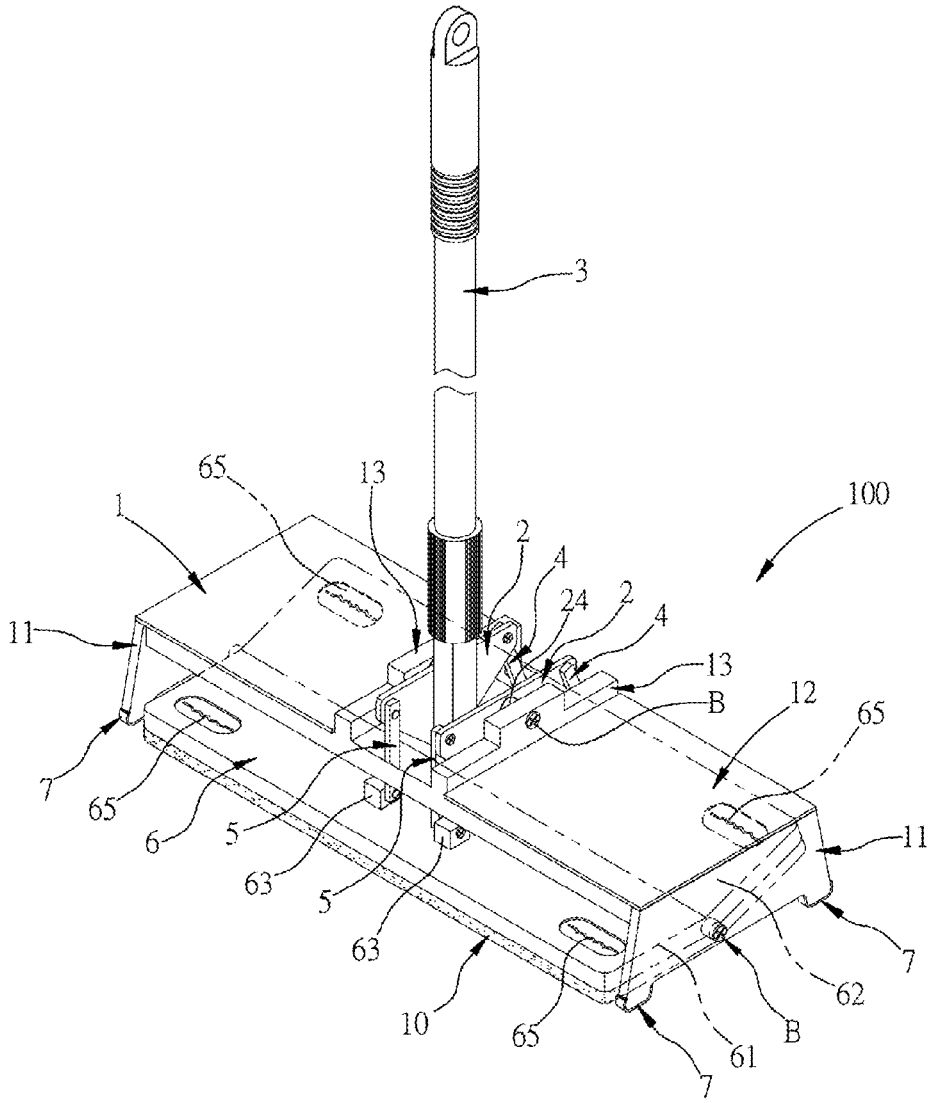
FIG. 3 is a perspective view according to the preferred embodiment of the present invention.
Figure 4:
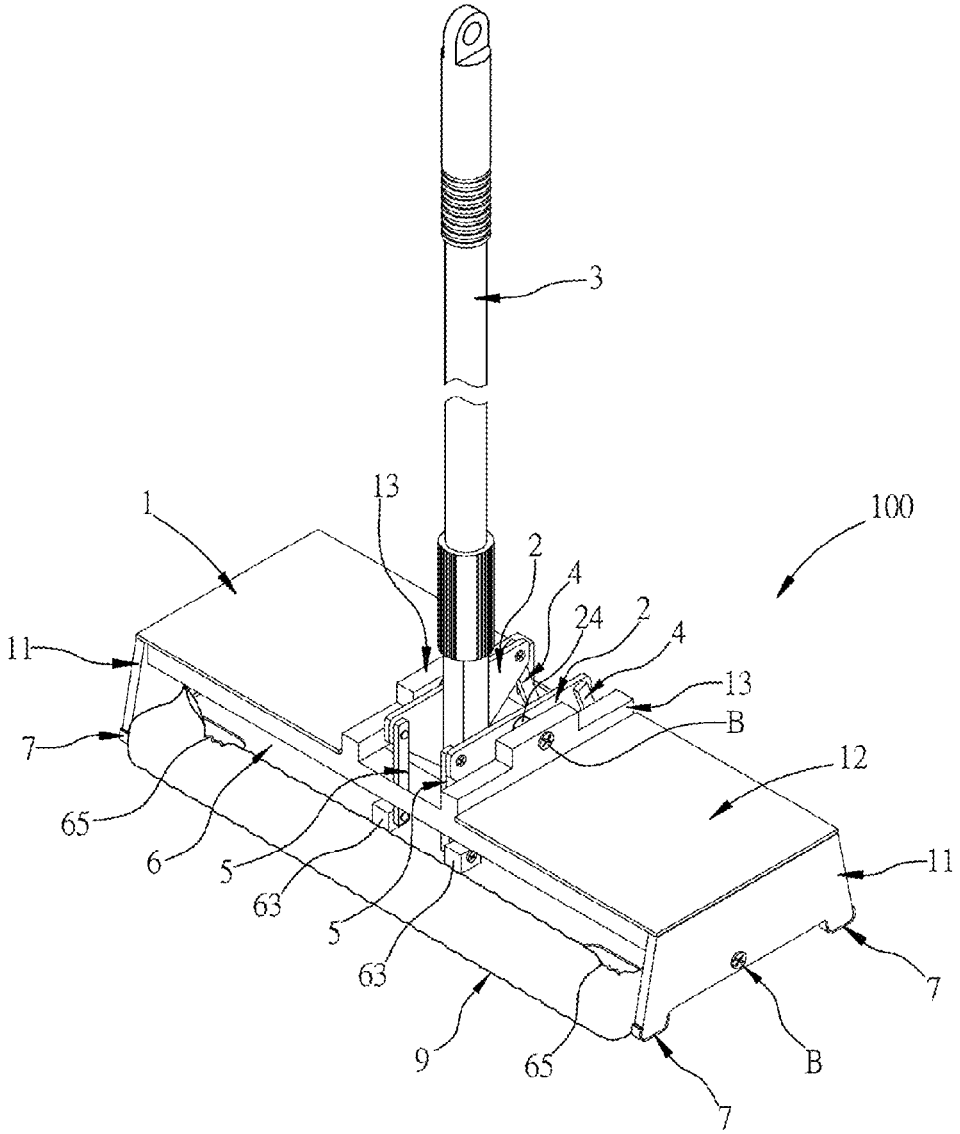
FIG. 4 is a perspective view of FIG. 3 in cooperation with a dusting paper.

Embodiments of the present invention will now be described, by way of example only, with reference to the accompanying drawings.

As shown in FIG. 2 to FIG. 7, the present invention discloses a flat mop tool 100. The flat mop tool 100 comprises a base 1, two first connecting members 2, a mop pole 3, two second connecting members 4, two third connecting members 5, and a board 6.

The base 1 has two side portions 11, a flat portion 12, and two raised portions 13. The two side portions 11 extend downward from two ends of the flat portion 12, respectively. A central portion of the flat portion 12 is formed with an opening 14. The two raised portions 13 are located at two ends of the opening 14, respectively. The axial direction of each raised portion 13 is parallel to the radial direction of the flat portion 12. Each raised portion 13 is formed with a first pivot hole 15 at a central portion thereof. Each side portion 11 is formed with a second pivot hole 16 at a central portion thereof.

Each first connecting member 2 has a reverse triangular shape. Each first connecting member 2 has a plate body 21, a front upper connecting hole 22, a rear upper connecting hole 23, a middle upper connecting hole 24, and a middle lower connecting hole 25. The front upper connecting hole 22 and the rear upper connecting hole 23 are formed at a front upper end and a rear upper end of the plate body 21, respectively. The middle upper connecting hole 24 is formed at a middle upper portion of the plate body 21 and located between the front upper connecting hole 22 and the rear upper connecting hole 23. The middle lower connecting hole 25 is formed at a middle lower end of the plate body 21 and corresponds to the middle upper connecting hole 24. The two first connecting members 2 are spaced and located in the opening 14. The middle upper connecting hole 24 of each first connecting member 2 is pivotally connected with the first pivot hole 15 of a corresponding one of the two raised portions 13.

The mop pole 3 passes through the opening 14 and is located between the two first connecting members 2. Two ends of a bottom end of the mop pole 3 are pivotally connected with the middle lower connecting holes 25 of the two first connecting members 2.

The two second connecting members 4 can be elongate boards, and are located in the opening 14 and beside the two first connecting members 2. An upper end of each second connecting member 4 is pivotally connected with the rear upper connecting hole 23 of a corresponding one of the two first connecting members 2. In this embodiment, each second connecting member 4 is located at the outer side of the corresponding first connecting member 2, but not limited to.

The two third connecting members 5 can be elongate boards, and are located in the opening 14 and beside the two first connecting members 2. An upper end of each third connecting member 5 is pivotally connected with the front upper connecting hole 22 of a corresponding one of the two first connecting members 2. In this embodiment, each third connecting member 5 is located at the inner side of the corresponding first connecting member 2, but not limited to.

The board 6 is located underneath the flat portion 12 of the base 1 and between the two side portions 11. Two ends of the board 6 are pivotally connected with the second pivot holes 16 of the two side portions 11, respectively. The board 6 has a first board portion 61 and a second board portion 62. An obtuse angle is defined between an upper surface of the first board portion 61 and an upper surface of the second board portion 62. The first board portion 61 is provided with two first pivot seats 63 corresponding in position to the two third connecting members 5. The second board portion 62 is provided with two second pivot seats 64 corresponding in position to the two second connecting members 4. A lower end of each third connecting member 5 is pivotally connected with a corresponding one of the two first pivot seats 63. A lower end of each second connecting member 4 is pivotally connected with a corresponding one of the two second pivot seats 64. Two ends of the upper surface of the first board portion 61 and the upper surface of the second board portion 62 are formed with retaining portions 65, respectively.

In an embodiment, a dusting paper 9 (or a dusting cloth) is provided to wrap a lower surface of the board 6. One side of the dusting paper 9 (or the dusting cloth) is bent upward to be retained by the retaining portions 65 of the first board portion 61. Another side of the dusting paper 9 (or the dusting cloth) is bent upward to be retained by the retaining portions 65 of the second board portion 62. In another embodiment, a dusting pad 10 with static is disposed under the board 6.

The flat mop tool 100 of the present invention further comprises four pads 7 or four wheels 8 disposed at two sides of the lower ends of the two side portions 11.

The foresaid "pivotal connection" is achieved through a screw B, but not limited to.

Figure 5:
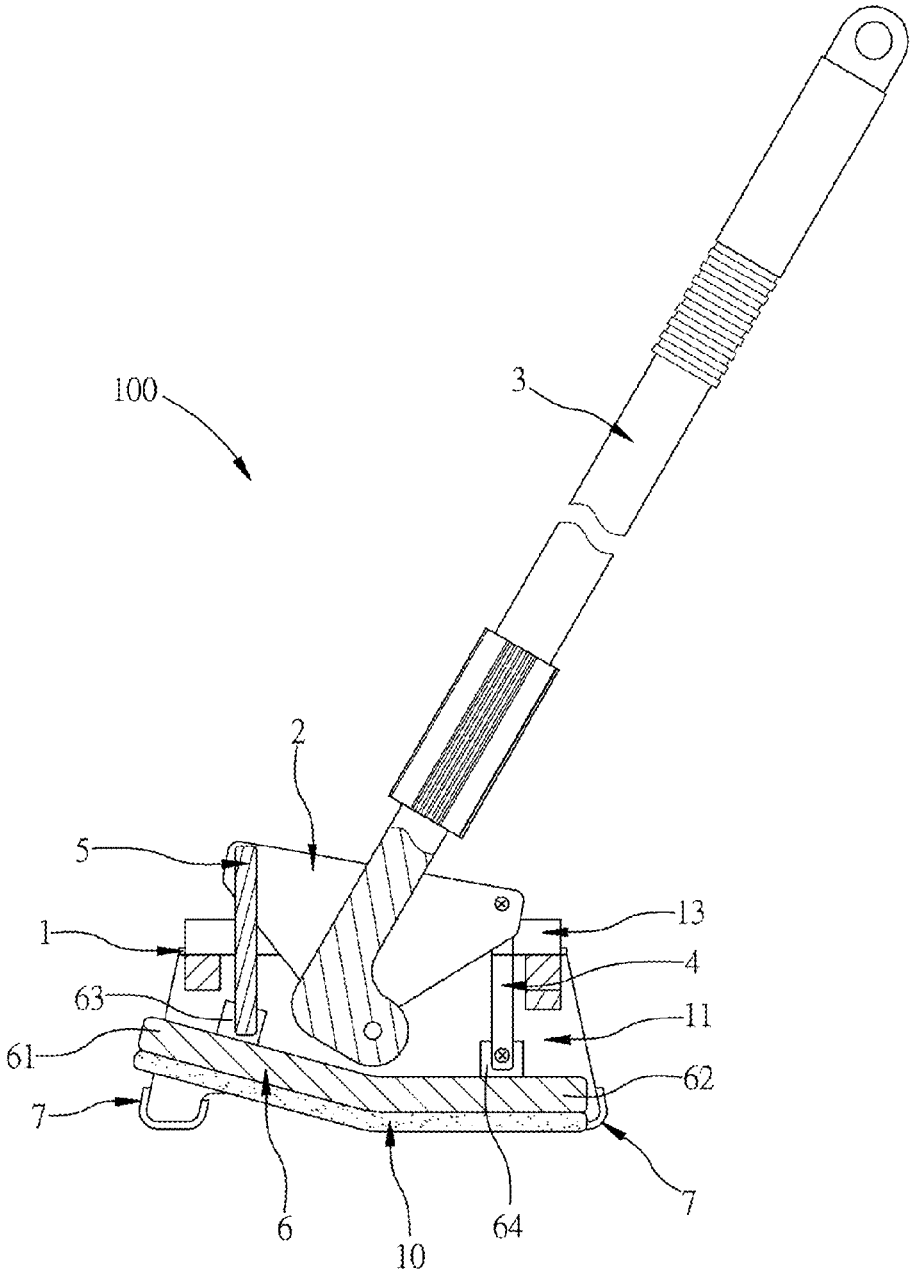
FIG. 5 is a sectional view showing that the flat mop tool of the present invention is moved forward for dusting.

According to the aforesaid structure, as shown in FIG. 5, when the user holds the mop pole 3 to move forward and apply a force (namely, toward the direction of the first board portion 61) by using the pads 7 and the wheels 8, the first connecting members 2 will be pushed forward and slant upward. The rear upper ends (namely, the position of the rear upper connecting holes 23) of the first connecting members 2 push the second board portion 62 downward through the second connecting members 4, such that a portion of the dusting paper 9 (or the dusting cloth) or the dusting pad 10, at the lower surface of the second board portion 62, is in contact with the ground tightly; meanwhile, the front upper ends (namely, the position of the front upper connecting holes 22) of the first connecting members 2 lift the first board portion 61 upward to be away from the ground through the third connecting members 5. Thus, the dust or objects on the ground are pushed forward to be underneath the first board portion 61 (or underneath the dusting paper 9 or the dusting cloth or the dusting pad 10 at the lower surface of the first board portion 61) to collect dust forward.

Figure 6:
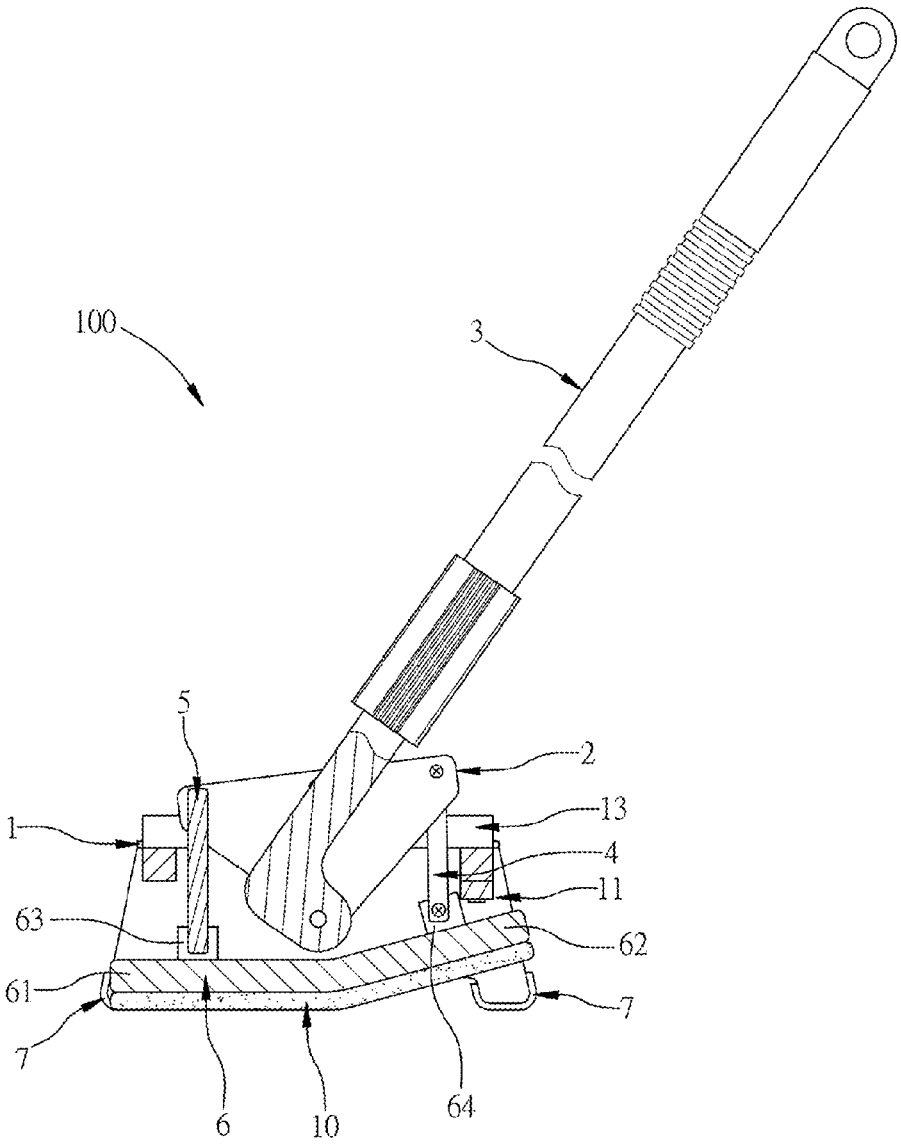
FIG. 6 is a sectional view showing that the flat mop tool of the present invention is moved rearward for dusting.
Figure 7:
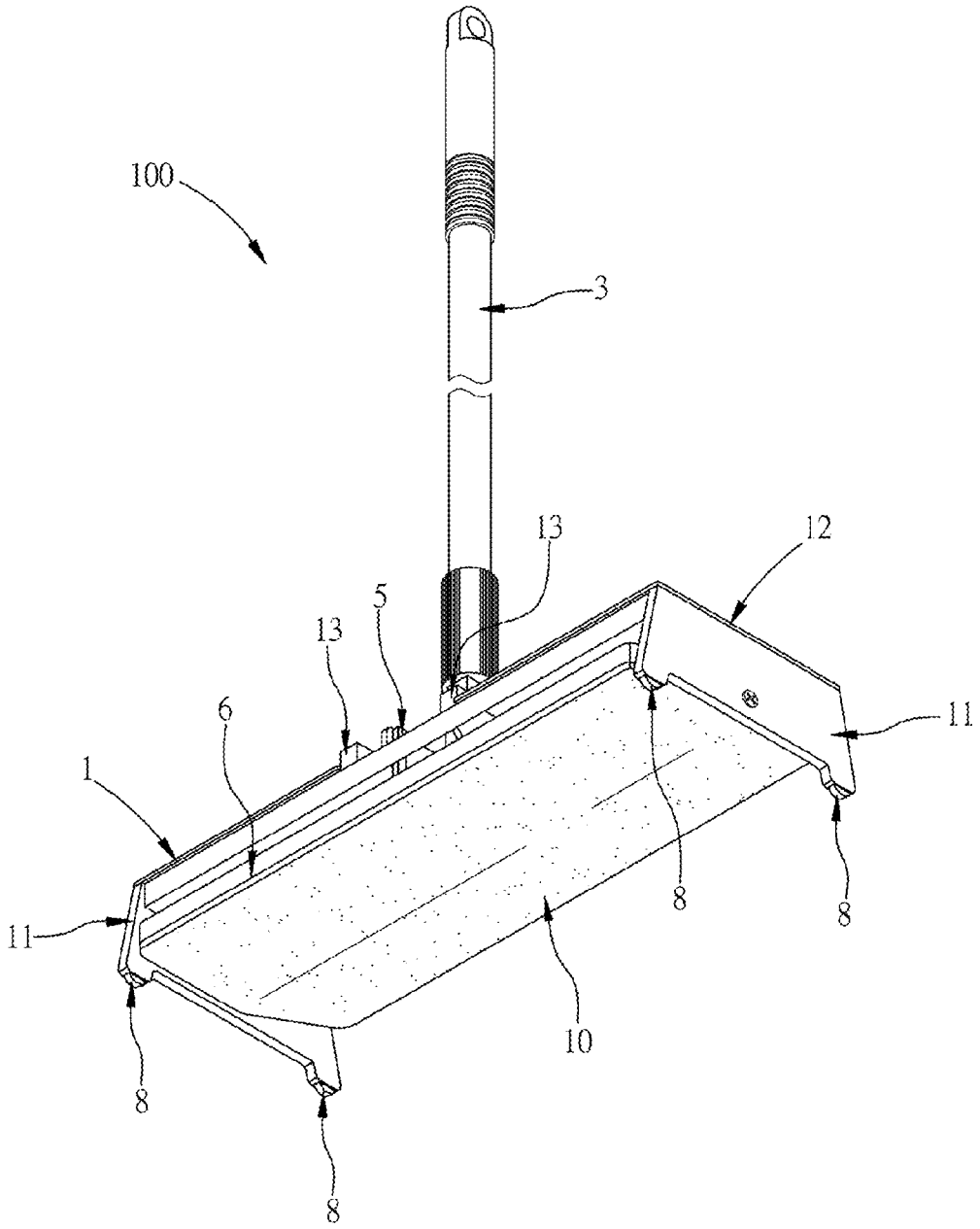
FIG. 7 is a bottom view of FIG. 3.

As shown in FIG. 6, when the user holds the mop pole 3 to move rearward and apply a force (namely, toward the direction of the second board portion 62) by using the pads 7 and the wheels 8, the first connecting members 2 will be pushed rearward to slant upward. The front upper ends (namely, the position of the front upper connecting holes 22) of the first connecting members 2 push the first board portion 61 downward to get contact with the ground through the third connecting members 5, such that a portion of the dusting paper 9 (or the dusting cloth) or the dusting pad 10, at the lower surface of the first board portion 61, is in contact with the ground tightly to collect and attract the dust or the objects therebetween; meanwhile, the rear upper ends (namely, the position of the rear upper connecting holes 23) of the first connecting members 2 lift the second board portion 62 upward through the second connecting members 4. Thus, the portion of the dusting paper 9 (or the dusting cloth) or the dusting pad 10, at the lower surface of the second board portion 62, is away from the ground, and the dust or objects on the ground are pushed rearward to be underneath the second board portion 62 (or underneath the dusting paper 9 or the dusting cloth or the dusting pad 10 at the lower surface of the second board portion 62) to collect dust rearward.

That is, the user can apply a force frontward to collect the front dust and to dust the rear dust and apply a force rearward to collect the rear dust and to dust the front dust. Thus, the present invention can be moved frontward and rearward for dusting.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A flat mop tool, comprising:

a base having two side portions, a flat portion, and two raised portions, the two side portions extending downward from two ends of the flat portion respectively, a central portion of the flat portion being formed with an opening, the two raised portions being located at two ends of the opening respectively, an axial direction of each raised portion being parallel to a radial direction of the flat portion, each raised portion being formed with a first pivot hole at a central portion thereof, each side portion being formed with a second pivot hole at a central portion thereof;

two first connecting members each having a plate body, a front upper connecting hole, a rear upper connecting hole, a middle upper connecting hole, and a middle lower connecting hole, the front upper connecting hole and the rear upper connecting hole being formed at a front upper end and a rear upper end of the plate body respectively, the middle upper connecting hole being formed at a middle upper portion of the plate body and located between the front upper connecting hole and the rear upper connecting hole, the middle lower connecting hole being formed at a middle lower end of the plate body and corresponding to the middle upper connecting hole, the two first connecting members being spaced and located in the opening, the middle upper connecting hole of each first connecting member being pivotally connected with the first pivot hole of a corresponding one of the two raised portions;

a mop pole, passing through the opening and located between the two first connecting members, two ends of a bottom end of the mop pole being pivotally connected with the middle lower connecting holes of the two first connecting members;

two second connecting members, located in the opening and beside the two first connecting members, an upper end of each second connecting member being pivotally connected with the rear upper connecting hole of a corresponding one of the two first connecting members;

two third connecting members, located in the opening and beside the two first connecting members, an upper end of each third connecting member being pivotally connected with the front upper connecting hole of a corresponding one of the two first connecting members; and a board, located underneath the flat portion of the base and between the two side portions, two ends of the board being pivotally connected with the second pivot holes of the two side portions respectively, the board having a first board portion and a second board portion, an obtuse angle being defined between an upper surface of the first board portion and an upper surface of the second board portion, the first board portion being provided with two first pivot seats corresponding in position to the two third connecting members, the second board portion being provided with two second pivot seats corresponding in position to the two second connecting members, a lower end of each third connecting member being pivotally connected with a corresponding one of the two first pivot seats, a lower end of each second connecting member being pivotally connected with a corresponding one of the two second pivot seats.

2. The flat mop tool as claimed in claim 1, wherein the two first connecting members each have a reverse triangular shape.

3. The flat mop tool as claimed in claim 2, further comprising four pads or four wheels disposed at two sides of lower ends of the two side portions.

4. The flat mop tool as claimed in claim 3, wherein two ends of the upper surface of the first board portion and the upper surface of the second board portion are formed with retaining portions, respectively.

5. The flat mop tool as claimed in claim 4, wherein a dusting paper or a dusting cloth is provided to wrap a lower surface of the board, one side of the dusting paper or the dusting cloth is bent upward to be retained by the retaining portions of the first board portion, and another side of the dusting paper or the dusting cloth is bent upward to be retained by the retaining portions of the second board portion.

6. The flat mop tool as claimed in claim 2, wherein two ends of the upper surface of the first board portion and the upper surface of the second board portion are formed with retaining portions, respectively.

7. The flat mop tool as claimed in claim 6, wherein a dusting paper or a dusting cloth is provided to wrap a lower surface of the board, one side of the dusting paper or the dusting cloth is bent upward to be retained by the retaining portions of the first board portion, and another side of the dusting paper or the dusting cloth is bent upward to be retained by the retaining portions of the second board portion.

8. The flat mop tool as claimed in claim 2, wherein a dusting pad is disposed under the board.

9. The flat mop tool as claimed in claim 3, wherein a dusting pad is disposed under the board.

10. The flat mop tool as claimed in claim 1, further comprising four pads or four wheels disposed at two sides of lower ends of the two side portions.

11. The flat mop tool as claimed in claim 10, wherein two ends of the upper surface of the first board portion and the upper surface of the second board portion are formed with retaining portions, respectively.

12. The flat mop tool as claimed in claim 11, wherein a dusting paper or a dusting cloth is provided to wrap a lower surface of the board, one side of the dusting paper or the dusting cloth is bent upward to be retained by the retaining portions of the first board portion, and another side of the dusting paper or the dusting cloth is bent upward to be retained by the retaining portions of the second board portion.

13. The flat mop tool as claimed in claim 10, wherein a dusting pad is disposed under the board.

14. The flat mop tool as claimed in claim 1, wherein two ends of the upper surface of the first board portion and the upper surface of the second board portion are formed with retaining portions, respectively.

15. The flat mop tool as claimed in claim 14, wherein a dusting paper or a dusting cloth is provided to wrap a lower surface of the board, one side of the dusting paper or the dusting cloth is bent upward to be retained by the retaining portions of the first board portion, and another side of the dusting paper or the dusting cloth is bent upward to be retained by the retaining portions of the second board portion.

16. The flat mop tool as claimed in claim 1, wherein a dusting pad is disposed under the board.

* * * * *